US008725501B2

(12) United States Patent
Ehara

(10) Patent No.: US 8,725,501 B2
(45) Date of Patent: May 13, 2014

(54) AUDIO DECODING DEVICE AND COMPENSATION FRAME GENERATION METHOD

(75) Inventor: Hiroyuki Ehara, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1745 days.

(21) Appl. No.: 11/632,770

(22) PCT Filed: Jul. 14, 2005

(86) PCT No.: PCT/JP2005/013051

§ 371 (c)(1),
(2), (4) Date: Sep. 14, 2007

(87) PCT Pub. No.: WO2006/009074

PCT Pub. Date: Jan. 26, 2006

(65) Prior Publication Data

US 2008/0071530 A1 Mar. 20, 2008

(30) Foreign Application Priority Data

Jul. 20, 2004 (JP) ..... 2004-212180

(51) Int. Cl.
*G10L 21/02* (2013.01)
*G10L 21/00* (2013.01)

(52) U.S. Cl.
USPC ..... 704/226; 704/200; 704/228

(58) Field of Classification Search
USPC ..... 704/200, 201, 211–228, 704/E19.001–E19.049, E21.001–E21.02; 375/240–241; 455/130–140
See application file for complete search history.

(56) References Cited

U.S. PATENT DOCUMENTS 5,001,758 A * 3/1991 Galand et al. ..... 704/212
5,235,669 A * 8/1993 Ordentlich et al. ..... 704/200
5,651,090 A * 7/1997 Moriya et al. ..... 704/200.1
5,732,389 A * 3/1998 Kroon et al. ..... 704/223
5,749,065 A * 5/1998 Nishiguchi et al. ..... 704/200.1
5,752,222 A * 5/1998 Nishiguchi et al. ..... 704/201

(Continued)

FOREIGN PATENT DOCUMENTS

EP 0 379 296 7/1990
EP 1207519 5/2002

(Continued)

OTHER PUBLICATIONS

Supplementary European Search Report dated May 20, 2009.

(Continued)

*Primary Examiner* — Pierre-Louis Desir
*Assistant Examiner* — David Kovacek
(74) *Attorney, Agent, or Firm* — Dickinson Wright PLLC

(57) ABSTRACT

There is disclosed an audio decoding device capable of improving audio quality of a decoded signal by considering the energy change of a past signal in eracure concealment processing. In this device, an energy change calculation unit (143) calculates an average energy of an audio source signal of one-pitch cycle from the end of the ACB vector outputted from an adaptive codebook (106). Moreover, the energy change calculation unit (143) calculates a ratio of the average energy of the current sub-frame and the sub-frame immediately before and outputs the ratio to an ACB gain generation unit (135). The ACB gain generation unit (135) outputs a conceal processing ACB gain defined by the ACB gain decoded in the past or information on the energy change ratio outputted from the energy change calculation unit (143) to a multiplier (132).

5 Claims, 12 Drawing Sheets

(56) References Cited

U.S. PATENT DOCUMENTS

| | | | | |
|---|---|---|---|---|
| 5,873,058 | A | 2/1999 | Yajima et al. | |
| 5,909,663 | A * | 6/1999 | Iijima et al. | 704/226 |
| 5,960,389 | A * | 9/1999 | Jarvinen et al. | 704/220 |
| 6,138,093 | A * | 10/2000 | Ekudden et al. | 704/228 |
| 6,334,105 | B1 * | 12/2001 | Ehara | 704/258 |
| 6,377,915 | B1 | 4/2002 | Sasaki | |
| 6,453,289 | B1 * | 9/2002 | Ertem et al. | 704/225 |
| 6,584,438 | B1 * | 6/2003 | Manjunath et al. | 704/228 |
| 6,636,829 | B1 * | 10/2003 | Benyassine et al. | 704/201 |
| 6,732,389 | B2 * | 5/2004 | Drexler | 5/486 |
| 7,167,828 | B2 * | 1/2007 | Ehara | 704/223 |
| 7,478,042 | B2 * | 1/2009 | Ehara et al. | 704/233 |
| 7,577,567 | B2 * | 8/2009 | Ehara | 704/223 |
| 2002/0007269 | A1 * | 1/2002 | Gao | 704/212 |
| 2002/0123887 | A1 * | 9/2002 | Unno | 704/220 |
| 2003/0074192 | A1 * | 4/2003 | Choi et al. | 704/219 |
| 2004/0039464 | A1 * | 2/2004 | Virolainen et al. | 700/94 |
| 2005/0154584 | A1 * | 7/2005 | Jelinek et al. | 704/219 |
| 2006/0089833 | A1 * | 4/2006 | Su et al. | 704/230 |
| 2006/0271357 | A1 * | 11/2006 | Wang et al. | 704/223 |
| 2006/0277042 | A1 * | 12/2006 | Vos et al. | 704/223 |
| 2007/0088543 | A1 * | 4/2007 | Ehara | 704/223 |
| 2007/0147518 | A1 * | 6/2007 | Bessette | 375/243 |
| 2007/0174052 | A1 * | 7/2007 | Manjunath et al. | 704/219 |
| 2008/0027711 | A1 * | 1/2008 | Rajendran et al. | 704/201 |
| 2008/0027718 | A1 * | 1/2008 | Krishnan et al. | 704/211 |
| 2008/0071530 | A1 * | 3/2008 | Ehara | 704/223 |
| 2008/0243496 | A1 * | 10/2008 | Wang | 704/226 |
| 2009/0265167 | A1 * | 10/2009 | Ehara et al. | 704/219 |
| 2010/0106488 | A1 * | 4/2010 | Ehara | 704/207 |

FOREIGN PATENT DOCUMENTS

| | | |
|---|---|---|
| JP | 6130999 | 5/1994 |
| JP | 09120298 | 5/1997 |
| JP | 9321783 | 12/1997 |
| JP | 10232699 | 9/1998 |
| JP | 2000267700 | 9/2000 |
| JP | 200113998 | 1/2001 |
| JP | 200151698 | 2/2001 |
| JP | 2001166800 | 6/2001 |
| JP | 2004102074 | 4/2004 |
| WO | 02/07061 | 1/2002 |

OTHER PUBLICATIONS

H. Ehara, et al., "An Energy Extrapolation-Based Algorithm for an Erased Excitation Signal," IEEE Signal Processing Letters, IEEE Service Center, Piscataway, NJ, vol. 12, No. 5, May 2005, pp. 411-414.

PCT International Search Report dated Oct. 25, 2005.

* cited by examiner

AUDIO DECODING DEVICE AND COMPENSATION FRAME GENERATION METHOD

TECHNICAL FIELD

The present invention relates to speech decoding apparatus and a repaired frame generating method.

BACKGROUND ART

With packet communication carried out in, for example, the Internet, when encoded information cannot be received at a decoding apparatus due to, for example, loss of packets in the transmission path, processing to repair (conceal) the loss of these packets is typically carried out.

For example, in the field of speech encoding, in the ITU-T recommendation G.729, frame erasure concealment processing is defined where: (1) a synthesis filter coefficient is repeatedly used; (2) pitch gain and fixed codebook gain (FCB gain) are gradually attenuated; (3) an internal state of an FCB gain predictor is gradually attenuated; and (4) a excitation signal is generated using one of an adaptive codebook or a fixed codebook based on determination results of a voiced mode/unvoiced mode in an immediately preceding normal frame (for example, refer to patent document 1).

In this method, voiced mode/unvoiced mode is determined using the magnitude of pitch prediction gain using pitch analysis results carried out at a post filter, and, for example, when a immediately preceding normal frame is a voiced frame, a excitation vector for a synthesis filter is generated using an adaptive codebook. An ACB (adaptive codebook) vector is generated from an adaptive codebook based on pitch lag generated for frame erasure concealment processing use, and this is multiplied with pitch gain generated for the frame erasure concealment processing use and becomes an excitation vector. Decoding pitch lag used immediately before is incremented and is used as the pitch lag for the frame erasure concealment processing use. The decoding pitch gain used immediately before is attenuated by a constant number of times and is used as the pitch gain for the frame erasure concealment processing use.

Patent Document 1: Japanese Patent Application Laid-open No. Hei.9-120298.

DISCLOSURE OF INVENTION

Problems to be Solved by the Invention

However, speech decoding apparatus of the related art decides pitch gain for the frame erasure concealment processing use based on past pitch gain. However, pitch gain is not always a parameter that reflects the energy evolution of the signal. The generated pitch gain for the frame erasure concealment processing use therefore does not take into consideration energy evolution of the signal in the past. Further, pitch gain is attenuated at a fixed ratio, pitch gain for the frame erasure concealment processing use is attenuated regardless of energy evolution of the signal in the past. Namely, energy evolution of a signal in the past is not taken into consideration and pitch gain is attenuated at a fixed rate, and, therefore, the concealed frame is less likely to hold continuity in energy from the past signal and is likely to have the feeling of sound break. Sound quality of the decoded signal deteriorates as a result.

It is therefore an object of the present invention to provide a speech decoding apparatus and a repaired frame generating method that are possible to take evolution of signal energy in the past into consideration and improve sound quality of a decoded signal in erasure concealment processing.

Means for Solving the Problem

A speech decoding apparatus of the present invention adopts a configuration having: an adaptive codebook that generates a excitation signal; a calculating section that calculates energy change between subframes of the excitation signal; a deciding section that decides gain of the adaptive codebook based on the energy change; and a generating section that generates repaired frames for lost frames using the gain of the adaptive codebook.

Advantageous Effect of the Invention

According to the present invention, in erasure concealment processing, it is possible to take evolution of signal energy in the past into consideration and improve sound quality of a decoded signal.

BEST MODE FOR CARRYING OUT THE INVENTION

Embodiments of the present invention will be described in detailed with reference to the accompanying drawings.

Embodiment 1

A speech encoding apparatus of Embodiment 1 of the present invention investigates energy evolution of a excitation signal generated in the past that is buffered in an adaptive codebook and generates pitch gain for an adaptive codebook—that is, adaptive codebook gain (ACB gain)—so that energy evolution is maintained. As a result, energy evolution from a past signal of a excitation vector generated for use as a repaired frame for a lost frame is improved, and energy evolution of a signal saved in an adaptive codebook is maintained.

Figure 1:
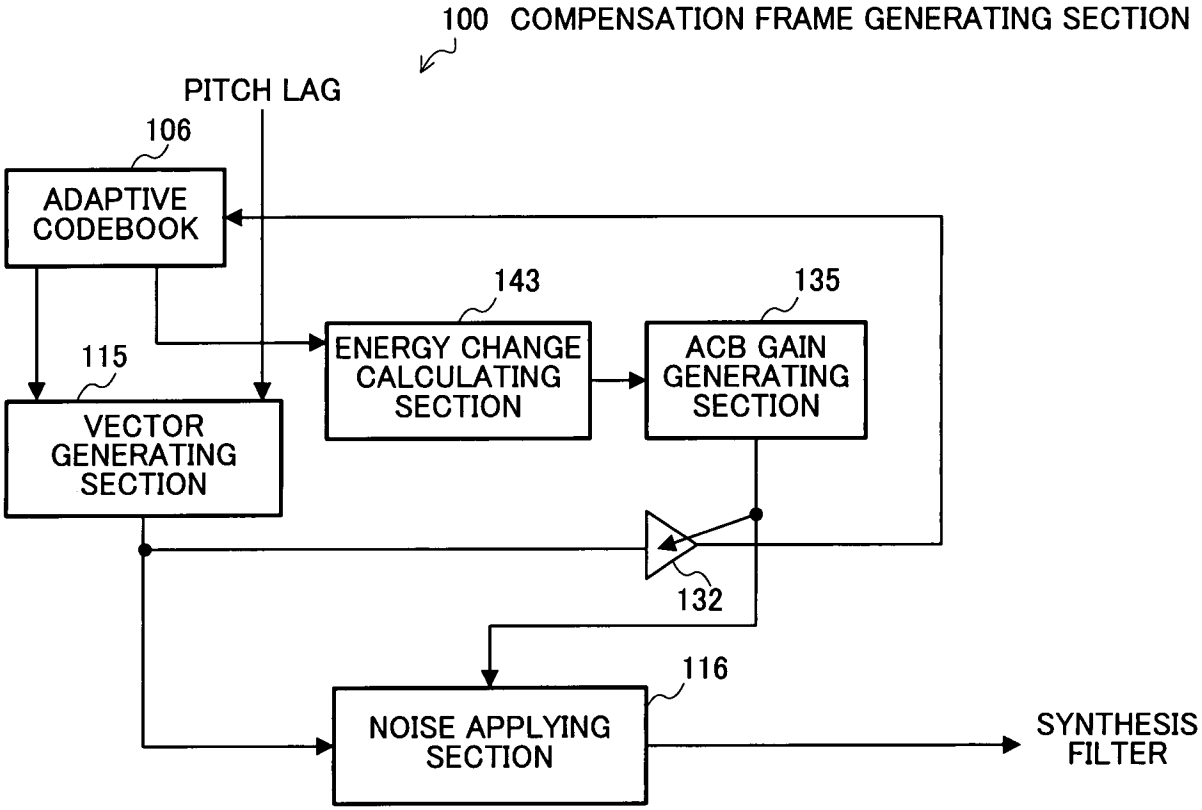
FIG. 1 is a block diagram showing a main configuration of a repaired frame generating section of Embodiment 1.

FIG. 1 is a block diagram showing a main configuration of repaired frame generating section 100 in a speech decoding apparatus of Embodiment 1 of the present invention.

This repaired frame generating section 100 has: adaptive codebook 106; vector generating section 115; noise applying section 116; multiplier 132; ACB gain generating section 135; and energy change calculating section 143.

Energy change calculating section 143 calculates average energy of a excitation signal for one pitch period from the end of an ACB (adaptive codebook) vector outputted from adaptive codebook 106. On the other hand, internal memory of energy change calculating section 143 holds average energy of a excitation signal for one pitch period which is similarly calculated at an immediately preceding subframe. Here, energy change calculating section 143 calculates a ratio of average energy of a excitation signal for a one pitch period between a current subframe and an immediately preceding subframe. This average energy may also be the square root or logarithm of energy of the excitation signal. Energy change calculating section 143 further carries out smoothing processing on this calculated ratio between subframes, and outputs a smoothed ratio to ACB gain generating section 135.

Energy change calculating section 143 updates energy of the excitation signal for one pitch period, which is calculated at an immediately preceding subframe using energy of the excitation signal for one pitch period, which is calculated at the current subframe. For example, Ec is calculated in accordance with (Equation 1) below.

$$Ec=\sqrt{((\Sigma(ACB[Lacb-i]^2)/Pc)} \quad \text{(Equation 1)}$$

(Here, ACB[0:Lacb−1]:adaptive codebook buffer,

Lacb: adaptive codebook buffer length,

Pc: pitch period for current subframe,

Ec: average amplitude for excitation signal for one pitch period in the past for current subframe (square root of energy) i=1, 2, . . . , Pc)

Next, energy change calculating section 143 holds Ec calculated at the immediately preceding subframe as Ep, and calculates energy change rate Re as Re=Ec/Ep. Energy change calculating section 143 then clips Re at 0.98, performs smoothing using the equation Sre=0.7×Sre+0.3×Re, and outputs the smoothed energy change rate Sre to ACB gain generating section 135. Energy change calculating section 143 then finally updates Ep by setting Ep=Ec.

In this way, it is possible to maintain energy evolution by calculating energy change and deciding ACB gain. If excitation generation is then carried out from only the adaptive codebook using the decided ACB gain, it is possible to generate an excitation vector for which energy evolution is maintained.

ACB gain generating section 135 selects one of ACB gain for concealment processing use defined using ACB gain decoded in the past and ACB gain for concealment processing use defined using energy change rate information outputted from energy change calculating section 143, and outputs final ACB gain for concealment processing use to multiplier 132.

Here, energy change rate information is an inter-subframe smoothed ratio between average amplitude A(−1) obtained from the last one pitch period of the immediately preceding subframe and average amplitude A(−2) obtained from the last one pitch period of two subframes previous, i.e. A(−1)/A(−2), and it represents the power change of a decoded signal in the past and is basically assumed to be ACB gain. However, when ACB gain for concealment processing use determined using ACB gain decoded in the past is larger than the energy change rate information described above, the ACB gain for concealment processing use determined using ACG gain decoded in the past may be chosen as ACB gain for actual concealment processing use. Further, clipping takes place at the upper limit value when the ratio of A(−1)/A(−2) exceeds the upper limit value. For example, 0.98 is used as the upper limit value.

Vector generating section 115 generates a corresponding ACB vector from adaptive codebook 106.

Repaired frame generating section 100 above decides ACB gain using only energy change of signals in the past, regardless of the strength/weakness of voicedness. Accordingly, although the feeling of sound break is mitigated, there are cases where ACB gain is high even though voicedness is weak, and, in such cases, a large buzzer sound occurs.

Here, with this embodiment, to achieve a natural sound quality, noise applying section 116 for applying noise to vectors generated from adaptive codebook 106 is provided as an independent system from a feedback loop to adaptive codebook 106.

Applying noise to an excitation vector at noise applying section 116 is carried out by applying noise to specific frequency band components of an excitation vector generated by adaptive codebook 106. More specifically, a high band component of an excitation vector generated by adaptive codebook 106 is removed by passing through a low-pass filter, and a noise signal having the same energy as the signal energy of the removed high-band component is applied. This noise signal is produced using the excitation vector generated from the fixed codebook by passing through a high-pass filter which removes a low band component. The low-pass filter and the high-pass filter use a perfect reconfiguration filter bank where a stop band and a pass band are mutually opposite or an item pursuant to that.

With the above configuration, it is possible to save characteristics of the last excitation waveform received correctly in adaptive codebook 106, and, at the same time, it is possible to apply various noise to modify characteristics of a generated excitation vector arbitrarily. Further, even if noise is applied to the excitation vector, energy of the excitation vector before the noise application is saved, there is therefore no impact on energy evolution.

Figure 2:
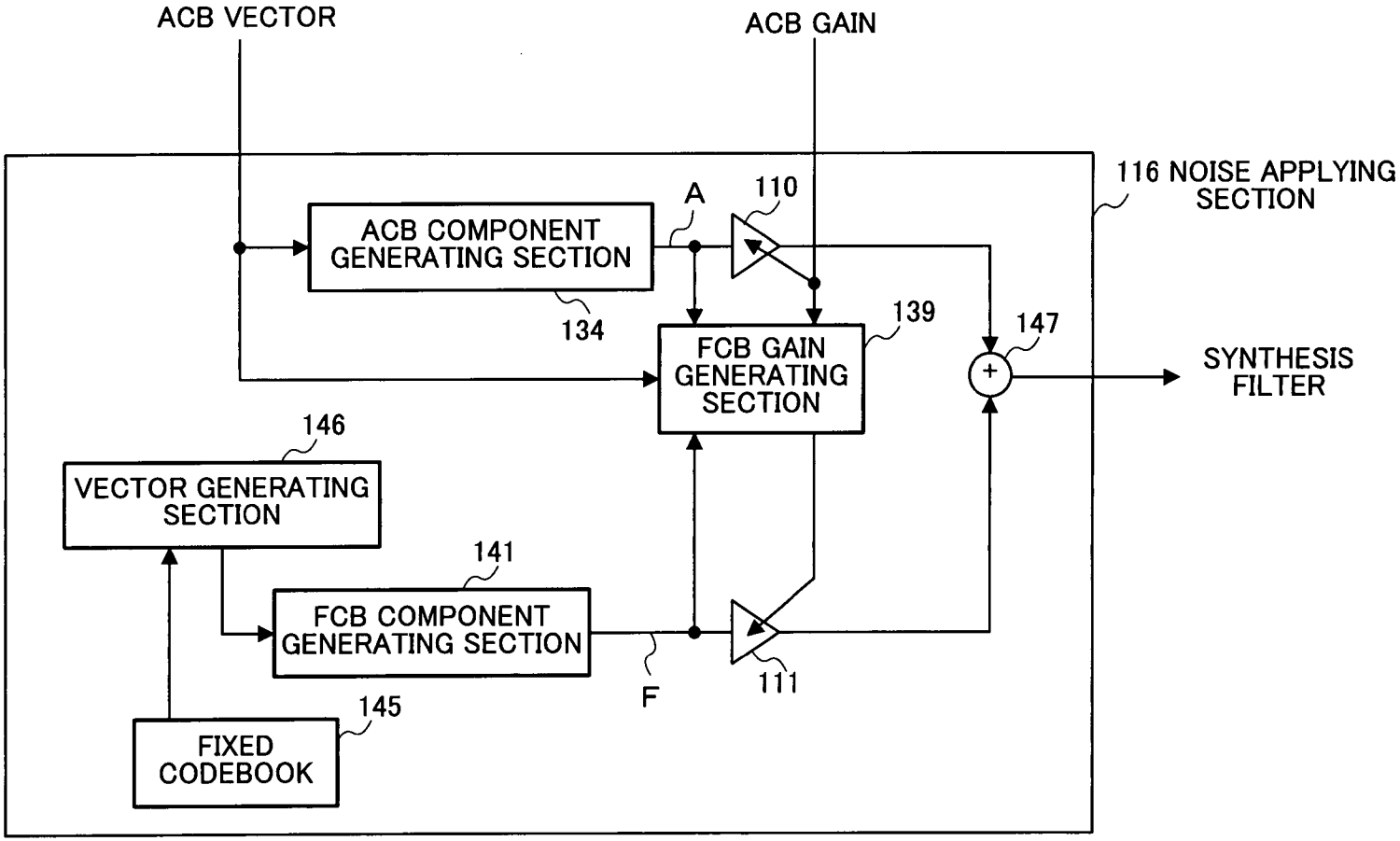
FIG. 2 is a block diagram showing a main configuration in a noise applying section of Embodiment 1.

FIG. 2 is a block diagram showing the main configuration in noise applying section 116.

This noise applying section 116 has: multipliers 110 and 111; ACB component generating section 134; FCB gain generating section 139; FCB component generating section 141; fixed codebook 145; vector generating section 146; and adder 147.

ACB component generating section 134 allows ACB vectors outputted from vector generating section 115 to pass through a low-pass filter, generates a component of a frequency band for which noise is not applied, among the ACB vectors outputted from vector generating section 115, and outputs this component as an ACB component. ACB vector A after passing through the low-pass filter is then outputted to multiplier 110 and FCB gain generating section 139.

FCB component generating section 141 allows FCB (fixed codebook) vectors outputted from vector generating section 146 to pass through a high-pass filter, generates a component of a frequency band for which noise is applied, among the FCB vectors outputted from vector generating section 146, and outputs this component as an FCB component. FCB vector F after passing through the high-pass filter is then outputted to multiplier 111 and FCB gain generating section 139.

The low-pass filter and the high-pass filter are linear phase FIR filters.

FCB gain generating section 139 calculates FCB gain for concealment processing use as described below using ACB gain for concealment processing use outputted from ACB gain generating section 135, ACB vector A for concealment processing use outputted from ACB component generating section 134, an ACB vector before carrying out processing at ACB component generating section 134 inputted to ACB component generating section 134, and FCB vector F outputted from FCB component generating section 141.

FCB gain generating section 139 calculates energy Ed (square sum of elements of vector D) of difference vector D between the ACB vectors before processing and after processing at ACB component generating section 134. Next, FCB gain generating section 139 calculates energy Ef (square sum for elements of vector F) of FCB vector F. Next, FCB gain generating section 139 calculates a correlation function Raf (inner product of vectors A and F) for ACB vector A inputted fromACB component generating section 134 and FCB vector F inputted from FCB component generating section 141. Next, FCB gain generating section 139 calculates a correlation function Rad (inner product of vectors A and D) for ACB vector A inputted from ACB component generating section 134 and difference vectorD. FCBgaingeneratingsection 139 thencalculates gain using following (Equation 2).

$$(-Raf+\sqrt{(Raf\times Raf+Ef\times Ed+2\times Ef\times Rad)})/Ef \quad \text{(Equation 2)}$$

Where gain is given by √(Ed/Ef) when the solution is an imaginary or negative number. Finally, FCB gain generating section 139 multiplies ACB gain for concealment processing use generated by ACB gain generating section 135 with gain obtained using (Equation 2) in the above and obtains FCB gain for concealment processing use.

The description above is an example of a method for calculating FCB gain for concealment processing use so that energy of the following two vectors becomes identical. Here, of the two vectors, one is a vector where ACB gain for concealment use is multiplied with an original ACB vector inputted to ACB component generating section 134, and the other is a sum vector of a vector where ACB gain for concealment processing use is multiplied with ACB vector A and a vector where FCB gain for concealment processing use is multiplied with FCB vector F (unknown, here this is the subject of calculation).

Adder 147 takes the sum of the vector obtained by multiplying ACB gain determined by ACB gain generating section 135 with ACB vector A (ACB component of an excitation vector) generated at ACB component generating section 134 and the vector obtained by multiplying FCB gain determined by FCB gain generating section 139 with FCB vector F (FCB component of an excitation vector) generated at FCB component generating section 141 as a final excitation vector and outputs this to a synthesis filter. Further, a vector that is an ACB vector (before passing through the low-pass filter) inputted to ACB component generating section 134 multiplied with ACB gain for concealment processing use is fed back to adaptive codebook 106, adaptive codebook 106 is updated only with an ACB vector, and a vector obtained by adder 147 is taken to be an excitation signal for a synthesis filter.

Phase dispersion processing and processing for achieving pitch periodicity enhancement may also be applied to the excitation signal of the synthesis filter.

According to this embodiment, the ACB gain is decided at the energy change rate of the decoded speech signal in the past, and an excitation vector having energy equal to energy of an ACB vector generated with using this gain, so that it is possible to smooth the energy change of the decoded speech before and after the lost frame and make sound break less likely to occur.

Further, with the above configuration, updating of adaptive codebook 106 is carried out only using an adaptivecodevector, sothat, for example, itispossible to minimize the noisy perception in a subsequent frame occurring when updating adaptive codebook 106 using an excitation vector subjected to become noise in a random manner.

Moreover, in the above configuration, concealment processing at a stationary voiced section of a speech signal applies noise mainly to a high band (for example, 3 kHz) alone, and so it is possible to make noisy perception less likely to occur compared to a method of applying noise to the entire band of the related art.

Embodiment 2

In Embodiment 1, a repaired frame generating section has been described separately as an example of a configuration of a repaired frame generating section of the present invention. In Embodiment 2, an example of a configuration of a speech decoding apparatus when a repaired frame generating section of the present invention is implemented on the speech decoding apparatus is shown. Components that are the same as in Embodiment 1 are assigned the same codes, and their descriptions will be omitted.

Figure 3:
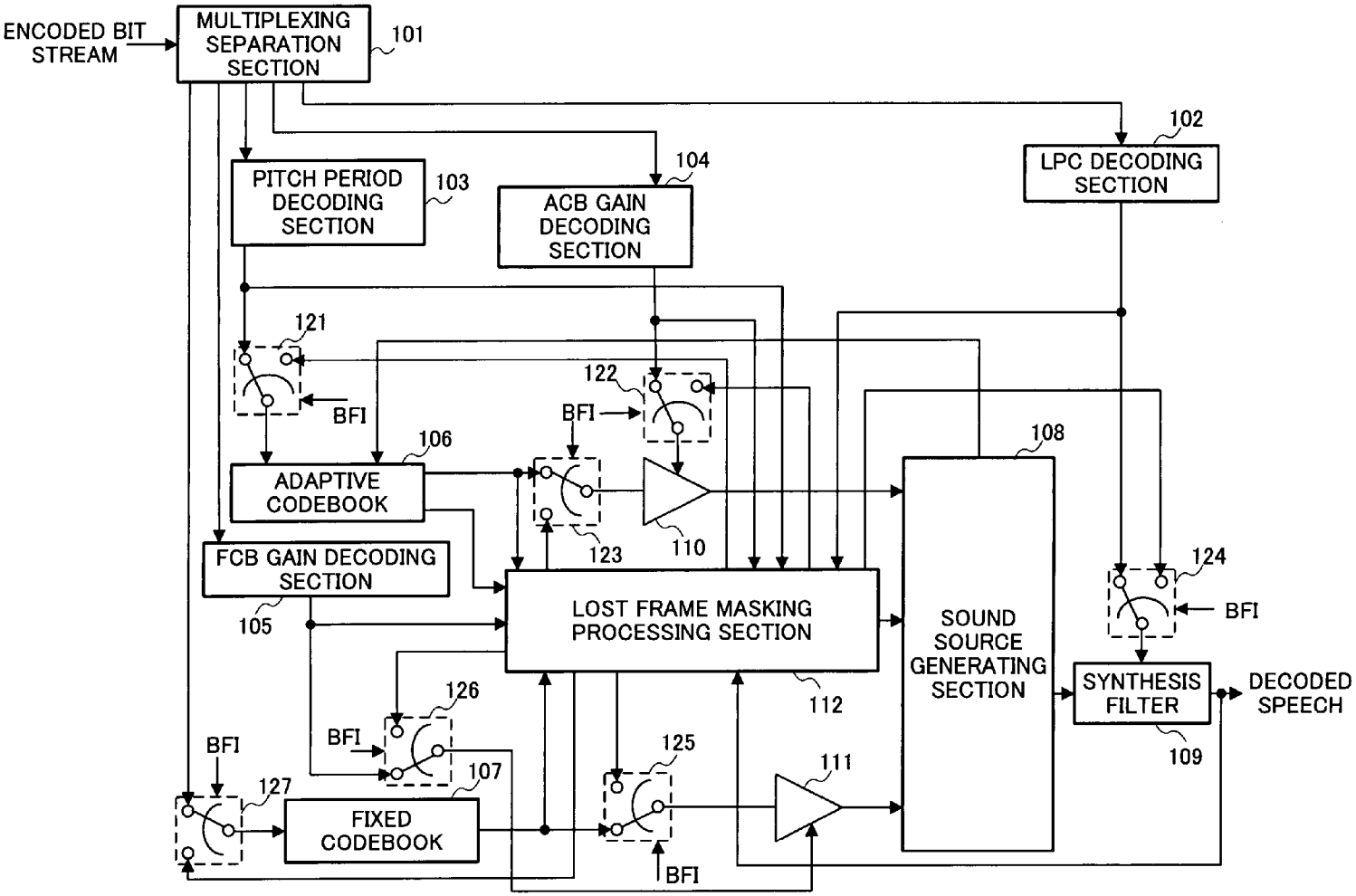
FIG. 3 is a block diagram showing a main configuration of a speech decoding apparatus of Embodiment 2.

FIG. 3 is a block diagram showing a main configuration of a speech decoding apparatus of Embodiment 2 of the present invention.

The speech decoding apparatus of this embodiment carries out normal decoding processing when the inputted frame is a correct frame, and carries out concealment processing on lost frames when the inputted frame is not a correct frame (the frame is lost). Switches 121 to 127 carry out switching in accordance with a BFI (Bad Frame Indicator) indicating whether or not an inputted frame is a correct frame and enable the two processes described above.

First, the operations of a speech decoding apparatus of this embodiment in normal decoding processing will be described. The state of the switch shown in FIG. 3 indicates a position of the switch in normal decoding processing.

Multiplexing separation section 101 separates encoded bit stream into the parameters (LPC code, pitch code, pitch gain code, FCB code and FCB gain code) and supplies them to corresponding decoding sections, respectively. LPC decoding section 102 decodes an LPC parameter from the LPC code supplied by multiplexing separation section 101. Pitch period decoding section 103 decodes a pitch period from the pitch code supplied by multiplexing separation section 101. ACB gain decoding section 104 decodes ACB gain from the ACB code supplied by multiplexing separation section 101. FCB gain decoding section 105 decodes FCB gain from the FCB gain code supplied by multiplexing separation section 101.

Adaptive codebook 106 generates an ACB vector using the pitch period outputted from pitch period decoding section 104 and outputs the result to multiplier 110. Multiplier 110 multiplies ACB gain outputted from ACB gain decoding section 104 with an ACB vector outputted from adaptive codebook 106, and supplies the gain scaled ACB vector to excitation generating section 108. On the other hand, fixed codebook 107 generates an FCB vector using a fixed codebook code outputted from multiplexing separation section 101 and output the result to multiplier 111. Multiplier 111 multiplies ACB gain outputted from FCB gain decoding section 105 with an FCB vector outputted from fixed codebook 107, and supplies the gain scaled FCB vector to excitation generating section 108. Excitation generating section 108 adds the two vectors outputted from multipliers 110 and 111, generates an excitation vector, feeds this back to adaptive codebook 106, and outputs the result to synthesis filter 109.

Excitation generating section 108 acquires an ACB gain multiplied ACB vector and an FCB gain multiplied FCB vector from multiplier 110 and from multiplier 111, respectively and give an excitation vector as a result of addition of the two. When there is no error, excitation generating section 108 feeds back this sum vector to adaptive codebook 106 as an excitation signal and outputs this to synthesis filter 109.

Synthesis filter 109 is a linear predictive filter configured with linear predictive coefficients (LPC) inputted via switch 124, taking an excitation signal vector outputted from excitation generating section 108 as input, carrying out filter processing, and outputting the decoded speech signal.

The outputted decoded speech signal is taken as a final output of the speech decoding apparatus after post processing of a post filter etc. Further, this is also outputted to a zero crossing rate calculating section (not shown) within lost frame concealment processing section 112.

Next, the operations of a speech decoding apparatus of this embodiment in concealment processing will be described. This processing is mainly performed by lost frame concealment processing section 112.

Still in the normal decoding processing, the decoding parameters (LPC parameters, pitch period, ACB gain, and FCB gain) obtained at LPC decoding section 102, pitch period decoding section 103, ACB gain decoding section 104 and FCB gain decoding section 105 are supplied to lost frame concealment processing section 112. Those four types of decoding parameters, decoded speech for the previous frame (output of synthesis filter 109), past generated excitation signal held in adaptive codebook 106, ACB vector generated for the current frame (lost frame) use, and FCB vector generated for the current frame (lost frame) use are inputted to lost frame concealment processing section 112. Lost frame concealment processing section 112 then carries out concealment processing for lost frames described below using these parameters, and outputs the LPC parameters, pitch period, ACB gain, fixed codebook, FCB gain, ACB vector, and FCB vector, which are obtained by the concealment processing.

An ACB vector for concealment processing use, ACB gain for concealment processing use, FCB vector for concealment processing use, and FCB gain for concealment processing use are generated, then the ACB vector for concealment processing use is outputted to multiplier 110, the ACB gain for concealment processing use is outputted to multiplier 110, the FCB vector for concealment processing use is outputted to multiplier 111 via switch 125, and the FCB gain for concealment processing use is outputted to multiplier 111 via switch 126.

At the time of performing concealment processing, excitation generating section 108 feeds back a vector, that is generated by multiplying the ACB vector (before LPF processing) inputted to ACB component generating section 134 with the ACB gain for concealment processing use, to adaptive codebook 106 (adaptive codebook 106 is updated using only the ACB vector), and takes a vector obtained through the above addition processing as an excitaion for a synthesis filter. When there is no error, phase dispersion processing and processing for achieving pitch periodicity enhancement may also be added to the excitation signal for the synthesis filter.

In the above description, lost frame concealment processing section 112 and excitation generating section 108 correspond to repaired frame generating section of Embodiment 1. Further, the codebook used in the noise applying process (fixed codebook 145 in Embodiment 1) is substituted with fixed codebook 107 of the speech decoding apparatus.

According to this embodiment, the repaired frame generating section can be implemented on a speech decoding apparatus as above described.

In the AMR scheme, processing corresponding to FCB code generating section 140 (described later) is carried out by randomly generating a bit stream per frame prior to starting decoding process per frame, and it is by no means necessary to provide a means for generating FCB code itself separately.

Further, the excitation signal outputted to synthesis filter 109 and the excitation signal fed back to adaptive codebook 106 do not have to be the same signal. For example, at the time of generating of an excitation signal outputted to synthesis filter 109, like in the AMR scheme, phase dispersion processing or processing to enhance pitch periodicity can be applied to FCB vector. In this case, the method of generating a signal outputted to codebook 106 should be identical to the configuration on the encoder side. As a result, subjective quality may further be improved.

Further, with this embodiment, FCB gain is inputted to lost frame concealment processing section 112 from FCB gain decoding section 105, but this is by no means necessary. In the method described above, FCB gain is necessary when it is necessary to obtain FCB gain for concealment processing before calculating FCB gain for concealment processing use. FCB gain is also necessary in a case of multiplying FCB gain for concealment processing use with the FCB vector F in advance to reduce dynamic range for avoiding degradation of calculating precision when a fixed point calculation of finite word length is performed.

Embodiment 3

Figure 4:
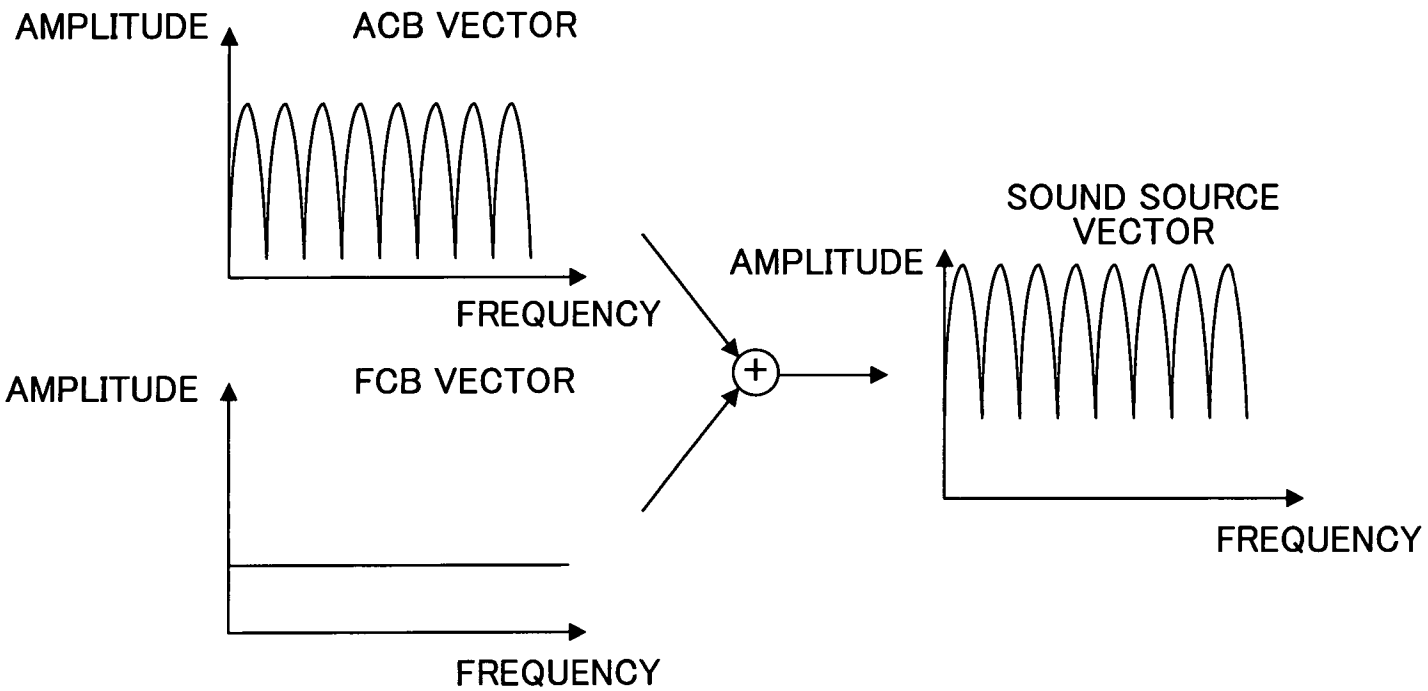
FIG. 4 is an example of generating a repaired frame using both an adaptive codebook and a fixed codebook.

With regards to lost frames having intermediate properties between voiced and unvoiced, it is preferable to generate repaired frames by mixing excitation vectors generated from both of the codebooks using an adaptive codebook and a fixed codebook as shown in FIG. 4. However, there are various cases in which this kind of an intermediate signal has less voiced characteristic. For example, it may be due to containing noise, change in power, or being in neighboring of a transient, onset, or word ending segments. Therefore when a configuration is provided where an excitation signal is generated by using a fixed codebook randomly generated in a fixed manner, a noisy perception is introduced into the decoded speech, and subjective quality deteriorates.

On the other hand, the CELP scheme speech decoding stores an excitation signal generated in the past in an adaptive codebook, and is based on a model that express an excitation signal for a current input signal using this excitation signal. That is, an excitation signal stored in the adaptive codebook is used in a recursive manner. As a result, once the excitation signal becomes noise-like, the subsequent frames are influenced by its propagation and become noisy, and this is a problem.

Figure 5:
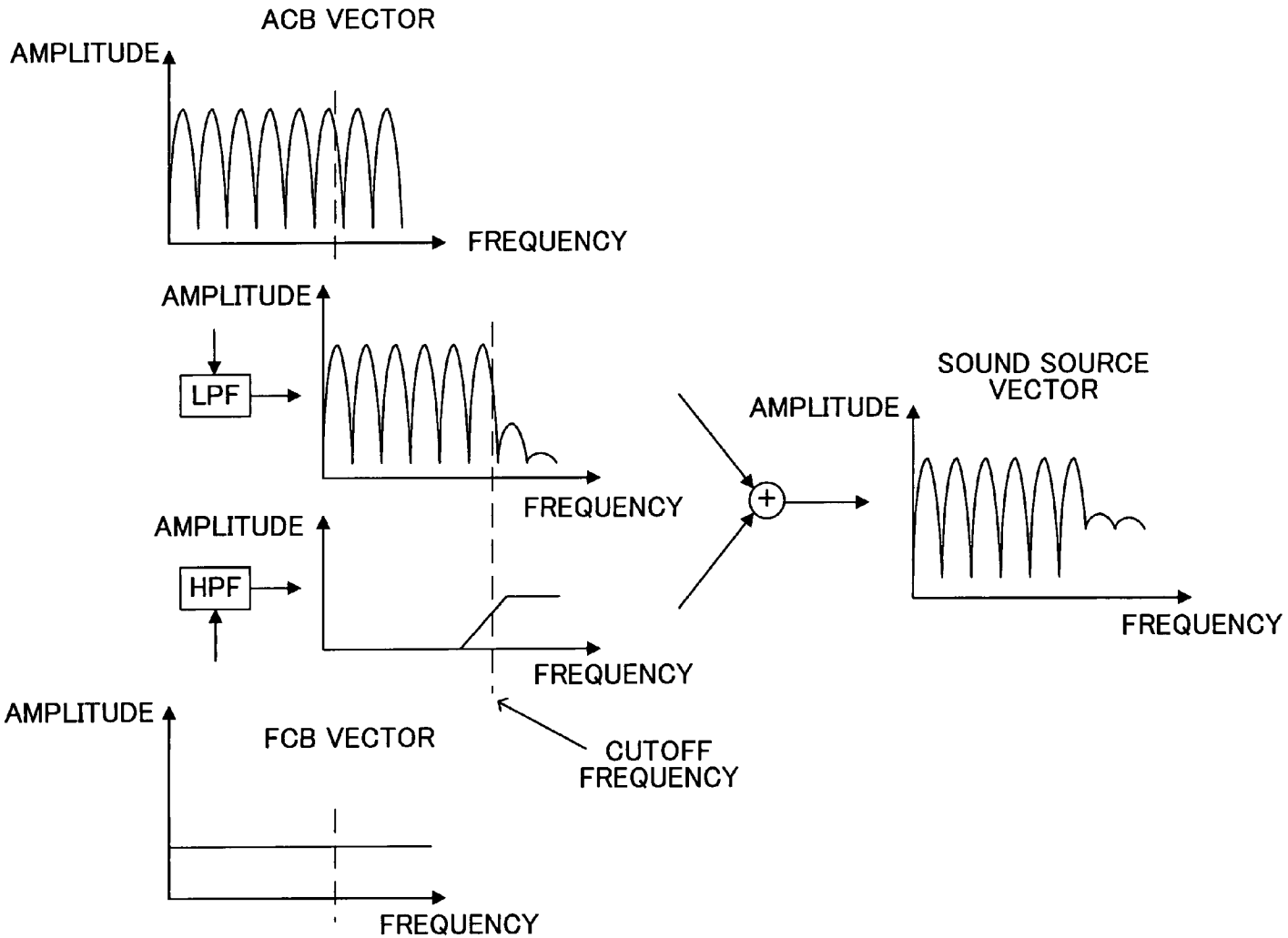
FIG. 5 is an example of processing that replaces a particular frequency components of an excitation signal generated using an adaptive codebook with a noise signal generated using a fixed codebook.

With this embodiment, as shown in FIG. 5, by replacing only some part of a frequency bandwidth of an excitation generated using an adaptive codebook with a noise signal generated using a fixed codebook, the influence of the noise on subjective quality is minimized. More specifically, only a high frequency band of an excitation generated by an adaptive codebook is replaced with a noise signal generated by a fixed codebook. This is because it is observed that the high-frequency component is noise-like in an actual speech signal, and natural subjective quality is more likely to be obtained than by applying noise to the entire bandwidth uniformly.

Further, with this embodiment, on applying noise, a mode determination section is newly provided to control degree of noise characteristic to be applied by switching a bandwidth of a signal to which noise is applied by a noise applying section based on the determined speech mode.

Synthesizing the excitation signal using excitation vectors generated by the band-limited adaptive codebook and the band-limited fixed codebook means that the ACB gain and FCB gain obtained for the previous frame that is a normal frame cannot be used as they are. This is because the gain for the synthesis vector of the excitaion vector generated by the adaptive codebook without band limitation and the fixed codebook without band limitation is different from the gain for the excitation vectors generated by the band-limited adaptive codebook and the band-limited fixed codebook. The repaired frame generating section shown in Embodiment 1 is therefore necessary in order to prevent discontinuities in energy between frames.

Further, when an excitation vector generated by a fixed codebook is subjected to mixing, the noise applying section shown in Embodiment 1 can be used.

As a result, it is possible to switch over to a signal bandwidth for applying noise to a decoding excitation signal according to characteristics of a speech signal (speech mode). For example, it is possible to make subjective quality of a decoded synthesis speech signal more natural by broadening the signal bandwidth to which noise is applied in a case of a mode with a low periodicity and strong noise characteristic, and by narrowing signal bandwidth to which noise is applied in a case of a mode with strong periodicity and voiced characteristic.

Figure 6:
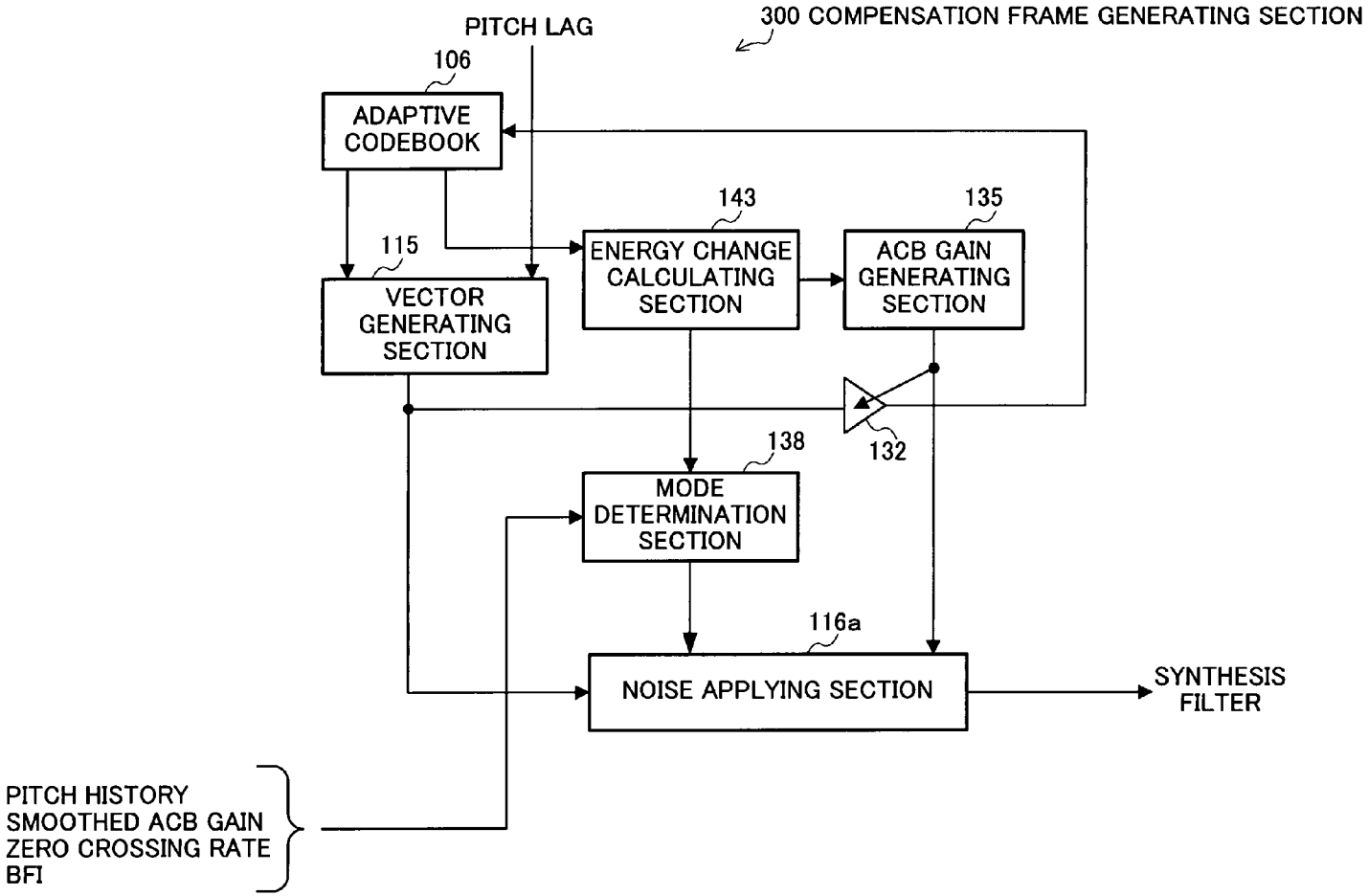
FIG. 6 is a block diagram showing a main configuration of a repaired frame generating section of Embodiment 3.

FIG. 6 is a block diagram showing a main configuration of repaired frame generating section 100*a* of Embodiment 3 of the present invention. This repaired frame generating section 10*a* has the same basic configuration as repaired frame generating section 100 shown in Embodiment 1, and the same components are assigned the same codes, and their description will be omitted.

Mode determination section 138 carries out mode determination of a decoded speech signal using the past decoding pitch period history, the zero crossing rate of a past decoded synthesis speech signal, smoothed ACB gain decoded in past, the energy change rate of a past decoded excitation signal, and the number of consecutively lost frames. Noise applying section 116*a* switches over a signal bandwidth to which noise is applied based on a mode determined at mode determination section 138.

Figure 7:
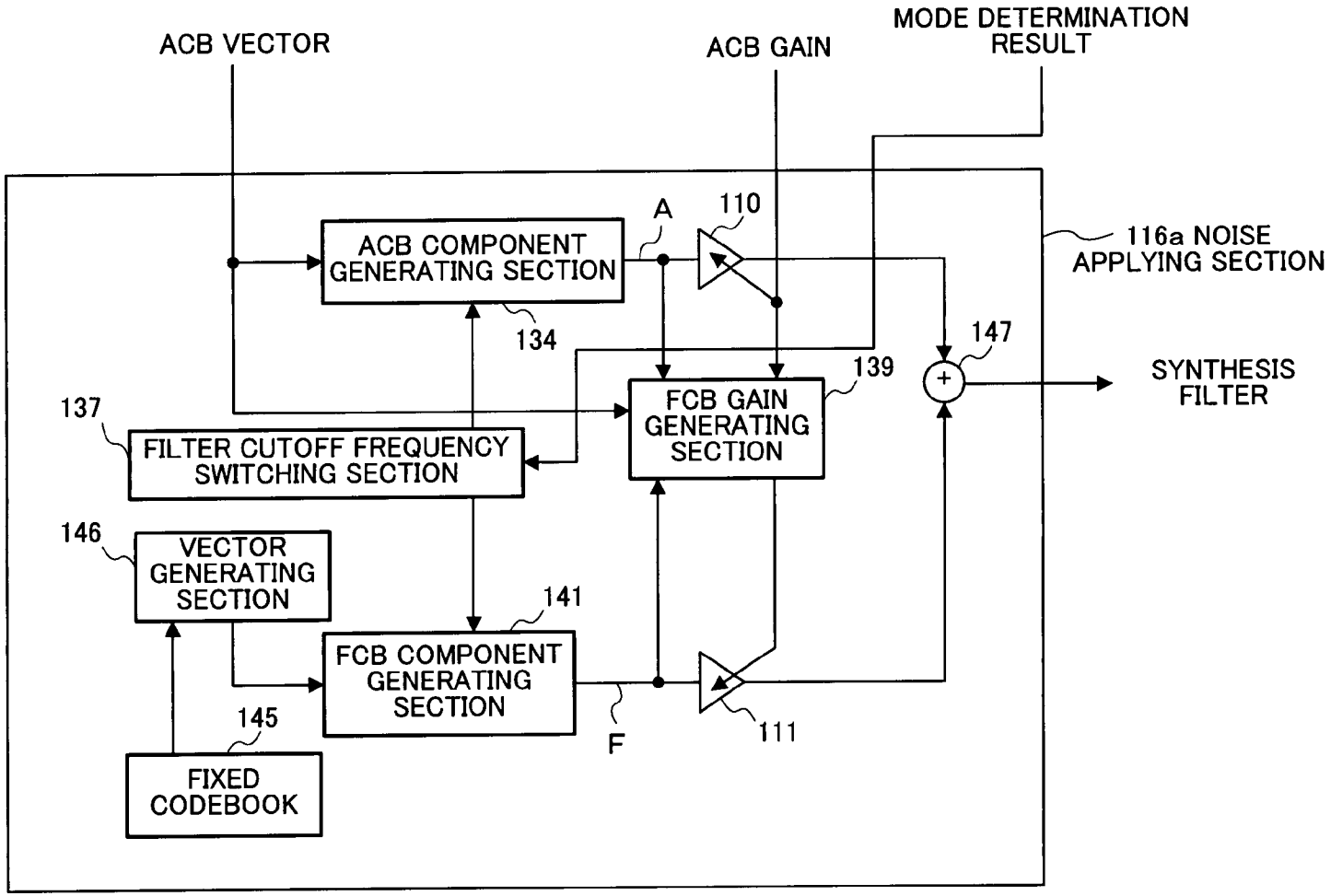
FIG. 7 is a block diagram showing a main configuration in a noise applying section of Embodiment 3.

FIG. 7 is a block diagram showing a main configuration in noise applying section 116*a*. This noise applying section 116*a* has the same basic configuration as noise applying section 116 shown in Embodiment 1, and the same component are assigned the same codes, and their descriptions will be omitted.

Filter cutoff frequency switching section 137 decides filter cutoff frequency based on the mode determination result outputted from mode determination section 138, and outputs filter coefficients corresponding to ACB component generating section 134 and FCB component generating section 141.

Figure 8:
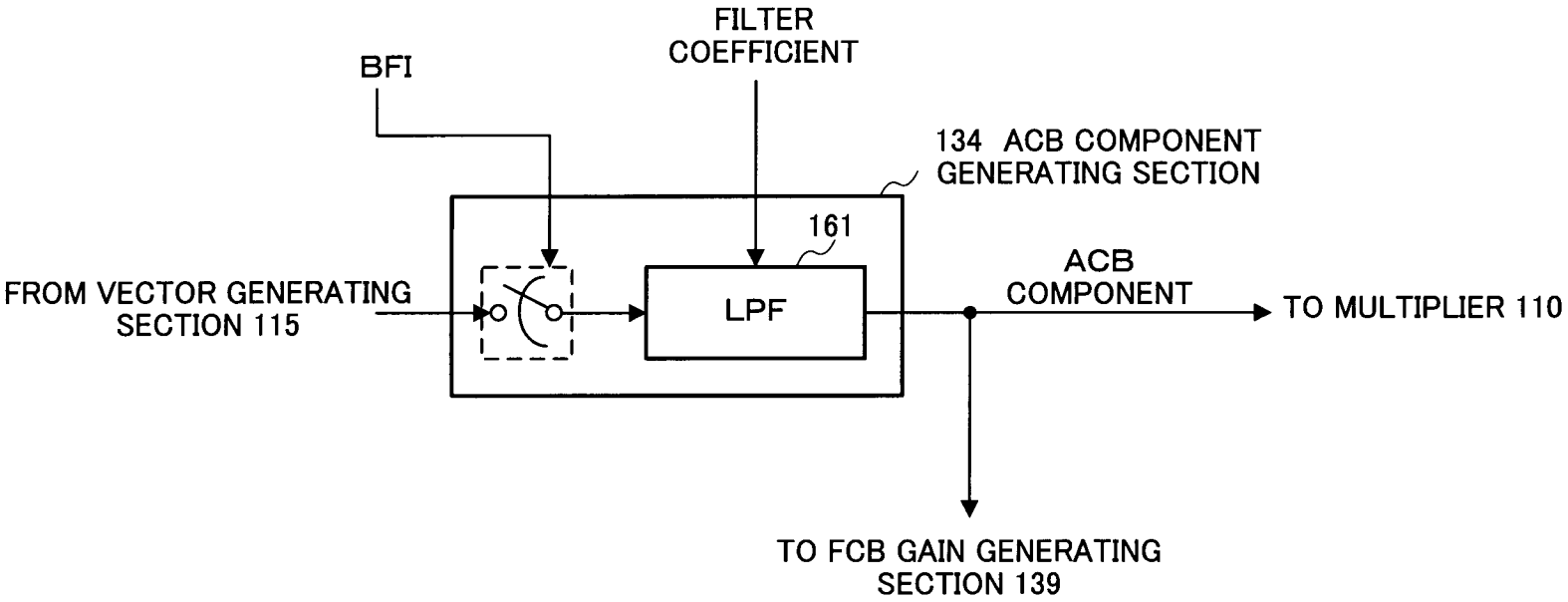
FIG. 8 is a block diagram showing a main configuration in an ACB component generating section of Embodiment 3.

FIG. 8 is a block diagram showing a main configuration in ACB component generating section 134 above.

When BFI indicates that the current frame is lost, ACB component generating section 134 generates a bandwidth component that has not had noise applied as an ACB component by passing the ACB vector, which is outputted from vector generating section 115, through LPF (low pass filter) 161. This LPF 161 is a linear phase FIR filter comprised of filter coefficients outputted from filter cutoff frequency switching section 137. Filter cutoff frequency switching section 137 stores filter coefficients set corresponding to a plurality of types of cutoff frequency, selects a filter coefficient corresponding to the mode determination result outputted from mode determination section 138, and outputs the filter coefficient to LPF 161.

A correspondence relationship between the cutoff frequency and speech mode of the filter is, for example, as shown below. This is an example in a case of telephone bandwidth speech, and a three mode configuration is used for a speech mode.

Voiced mode: cutoff frequency=3 kHz

Noise mode: cutoff frequency=0 Hz (entire bandwidth cutoff=ACB vector is zero vector).

Other mode(s): cutoff frequency=1 kHz

Figure 9:
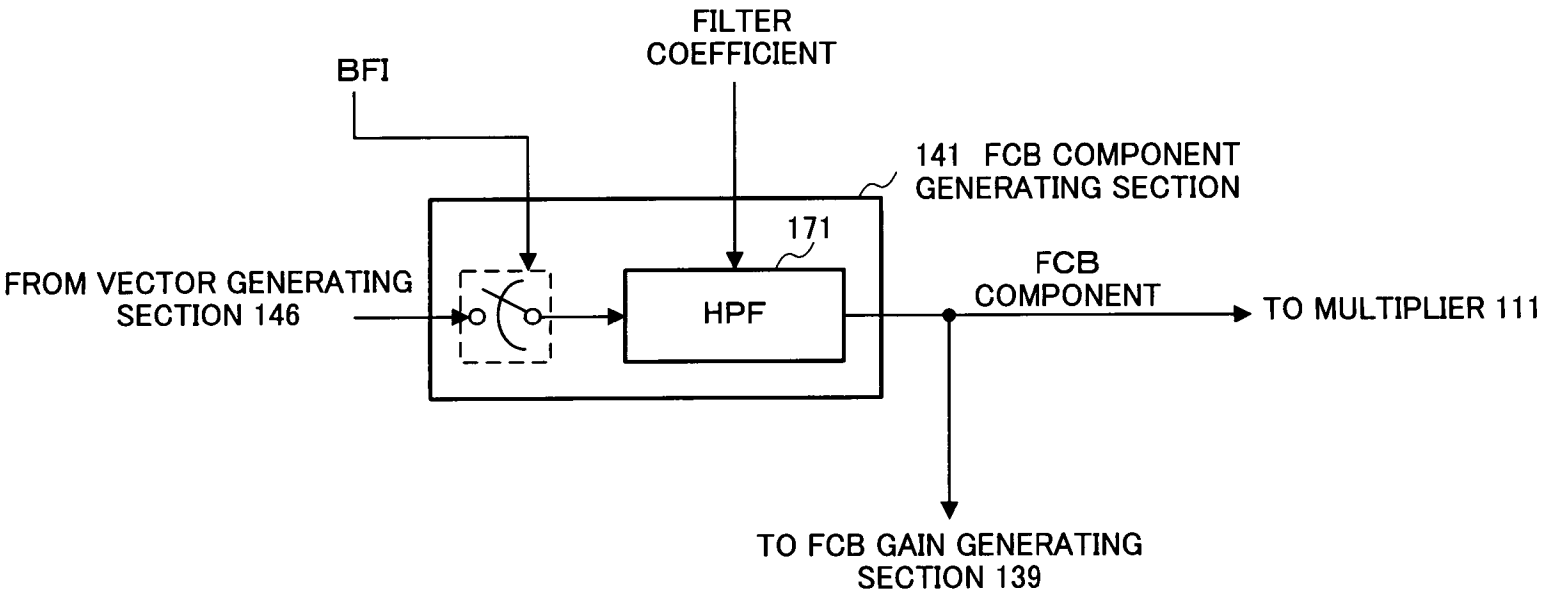
FIG. 9 is a block diagram showing a main configuration in an FCB component generating section of Embodiment 3.

FIG. 9 is a block diagram showing a main configuration in FCB component generating section 141.

FCB vector outputted from vector generating section 146 is inputted to high pass filter (HPF) 171 when BFI indicates a lost frame. HPF 171 is a linear phase FIR filter comprised of filter coefficients outputted from filter cutoff frequency switching section 137. Filter cutoff frequency switching section 137 stores filter coefficient sets corresponding to a plurality of types of cutoff frequencies, selects a set of filter coefficients corresponding to the mode determination result outputted from mode determination section 138, and outputs the set of filter coefficients to HPF 171.

A correspondence relationship of the cutoff frequency and speech mode of the filter is, for example, as shown below. This is also an example in the case of telephone band speech, and a three mode configuration is used for a speech mode.

Voiced mode: cutoff frequency=3 kHz

Noise mode: cutoff frequency=0 Hz (overall bandpass=FCB vector outputted as is)

Other mode(s): cutoff frequency=1 kHz

At this time, as the final FCB vector, it is effective to enhance in periodicity using pitch period processing as shown in (Equation 3) below if a signal having periodicity should be generated.

$$c(n)=c(n)+\beta c(n-T)[n=T,T+1,\ldots,L-1] \quad \text{(Equation 3)}$$

(where c(n) is an FCB vector, β is a pitch enhancement gain coefficient, T is a pitch period, and L is a subframe length).

Figure 10:
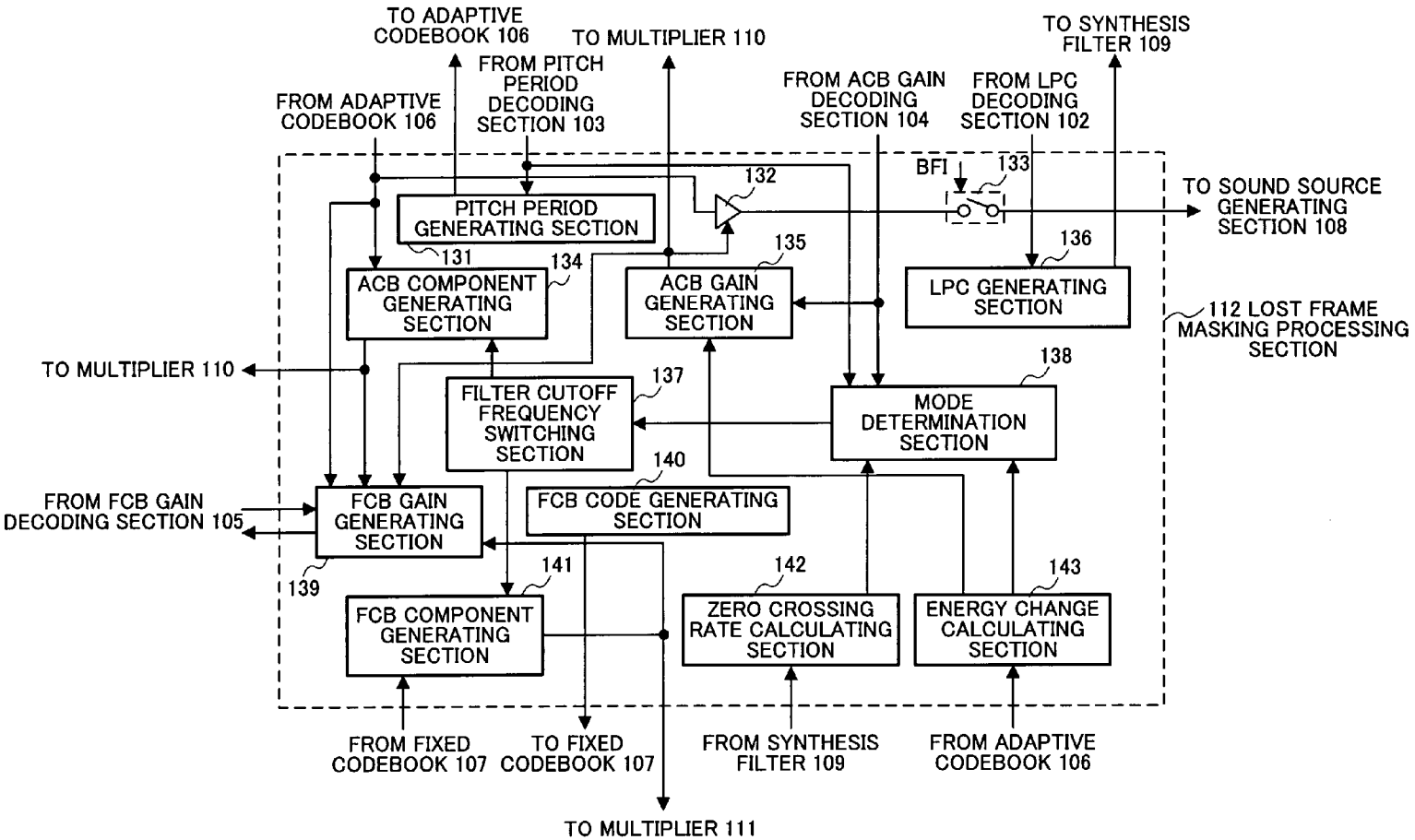
FIG. 10 is a block diagram showing a main configuration in a lost frame concealing processing section of Embodiment 3.

When a repaired frame generating section of this embodiment is implemented on a speech decoding apparatus as shown in Embodiment 2, this becomes as follows. FIG. 10 is a block diagram showing a main configuration in lost frame concealment processing section 112 in a speech decoding apparatus of this embodiment. Regarding the block already described, the same codes are assigned, and their description will be basically omitted.

LPC generating section 136 generates LPC parameters for concealment processing use based on decoded LPC information inputted in the past and outputs this to synthesis filter 109 via switch 124. For example, a method of generating LPC parameters for concealment processing use is as follows. For example, in an AMR scheme case, an LSP parameter for immediately before is shifted towards an average LSP parameter, and it becomes an LSP parameter for concealment processing use. Then this LSP is converted to an LPC parameter for concealment processing use. When frame erasure continues for a long time (for example, 3 frames or more in the case of 20 ms frame), it may be better to apply a weighting to the LPC parameter so as to perform bandwidth expansion of the synthesis filter. Assume that a transfer function of an LPC synthesis filter is 1/A(z), this weighting can be expressed by 1/A(z/γ), where the value of γ is a value approximately 0.99 to 0.97, or a value obtained by gradually lowering that value as an initial value. 1/A(z) conforms to (Equation 4) below.

$$1/A(z)=1/(1+\Sigma a(i)z-i) \quad \text{(Equation 4)}$$

(where i=1, . . . , p (where p is an LPC analysis order)

Pitch period generating section 131 generates a pitch period after mode determination at mode determination section 138. Specifically, in a case of a 12.2 kbps mode for the AMR scheme, a decoding pitch period (integer precision) of an immediately preceding normal subframe is outputted as a pitch period of a lost frame. Namely, pitch period generating section 131 has memory for holding a decoded pitch, updates this value per subframe, and outputs this buffer value as a pitch period at the time of concealment processing when an error occurs. Adaptive codebook 106 generates a corresponding ACB vector from this pitch period outputted from pitch period generating section 131.

FCB code generating section 140 outputs generated FCB code to fixed codebook 107 via switch 127.

Fixed codebook 107 outputs an FCB vector corresponding to the FCB code to FCB component generating section 141.

Zero crossing rate calculating section 142 takes a synthesis signal outputted from a synthesis filter as input, calculates zero crossing rate, and outputs the result to mode determination section 138. Here, the zero crossing rate is better to be calculated using an immediately preceding one pitch period in order to extract characteristics of a signal for an immediately preceding one pitch period (in order to reflect the characteristics at a portion closest in terms of time).

The parameters generated as above—that is, specifically, an ACB vector for masking processing use, ACB gain for masking processing use, an FCB vector for masking processing use, and FCB gain for masking processing use—are outputted to multiplier 110 via switch 123, multiplier 110 via switch 122, multiplier 111 via switch 125, multiplier 111 via switch 126, respectively.

Figure 11:
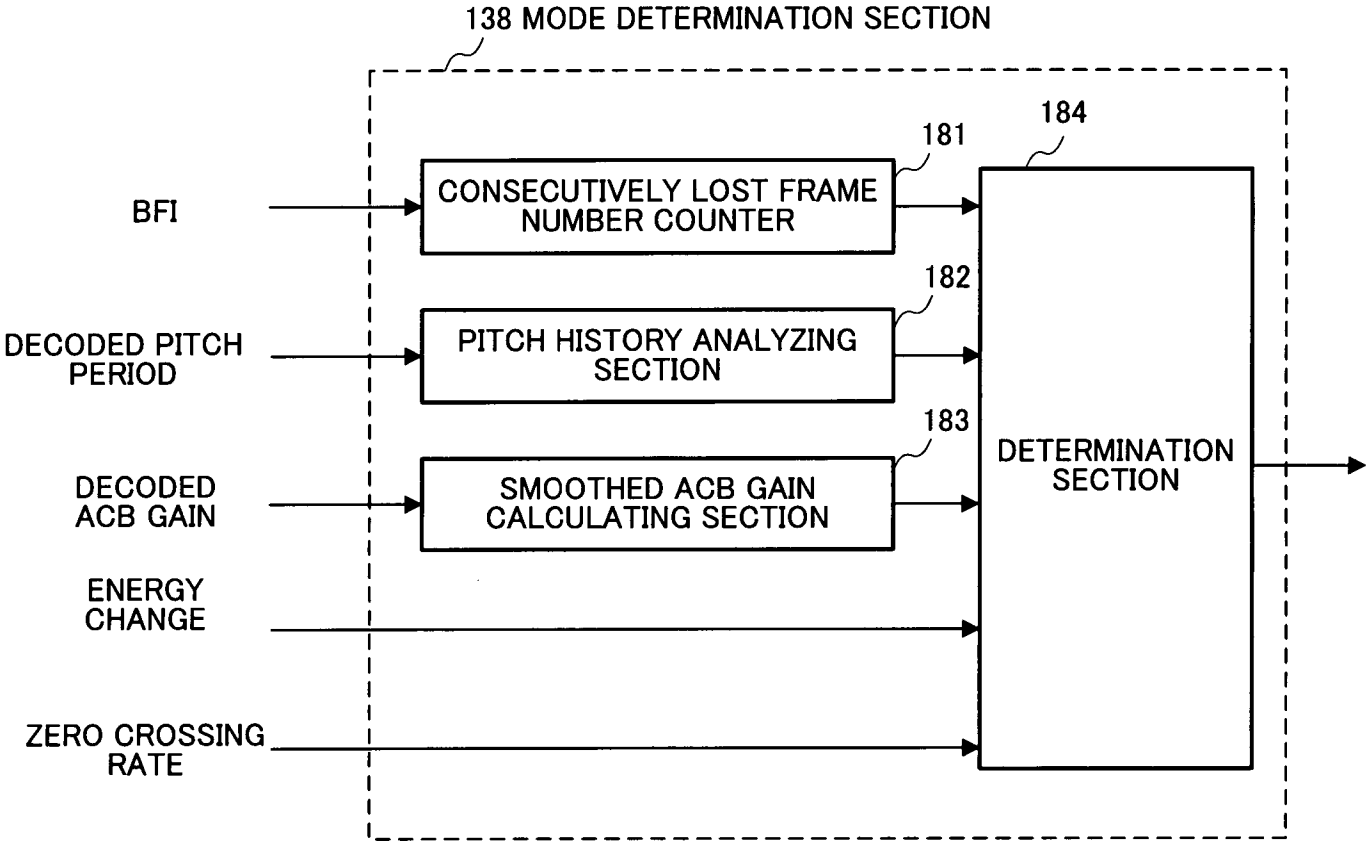
FIG. 11 is a block diagram showing a main configuration in a mode determination section of Embodiment 3.

FIG. 11 is a block diagram showing a major configuration in mode determination section 138.

Mode determination section 138 carries out mode determination using the pitch history analysis result, smoothing pitch gain, energy change information, zero crossing rate information, and the number of consecutively lost frames. Mode determination of the present invention is for frame loss concealment processing, and so this may be carried out one time (from the end of decoding processing for a normal frame until concealment processing where mode information is initially used is carried out) per frame, and with this embodiment, this is carried out at the beginning of excitation decoding processing of the first subframe.

Pitch history analyzing section 182 holds decoded pitch period information of a plurality of subframes in the past in a buffer, and determines voiced stationarity depending on whether fluctuation of pitch period in the past is large or small. More specifically, voiced stationarity is determined to be high if a difference between maximum pitch period and minimum pitch period within a buffer is within a predetermined threshold value (for example, within 15% of the maximum pitch period or smaller than ten samples (at the time of 8 kHz sampling)). If pitch period information per frame portion is buffered, pitch period buffer updating may be carried out once per frame (typically, at the end of the frame processing), and when this is not the case, may be carried out one time every subframe (typically, at the end of the subframe processing). The number of pitch periods held is about four immediately preceding subframes (20 ms). If voiced stationarity is not determined at the time of a multiple pitch error (error due to halving of pitch frequency) or half pitch error (error due to doubling of pitch frequency), when masking processing is carried out using multiple pitches or half-pitches, the occurrence of "falsetto voice" occurring when masking processing is carried out using multiple pitches or half pitches information does not occur.

Smoothed ACB gain calculating section 183 carries out smoothing processing between subframes in order to suppress the fluctuation between subframes of decoded ACB gain to some extent. For example, this is taken to be smoothing processing of an extent indicated by the equation below.

$$(\text{Smoothed } ACB \text{ gain})=0.7\times(\text{Smoothed } ACB \text{ gain})+0.3\times(\text{decoded } ACB \text{ gain})$$

Degree of voiced characteristics is determined to be high when calculated and smoothed ACB gain exceeds the threshold value (for example 0.7).

Determining section 184 carries out mode determination using the above parameters, and, in addition, energy change information and zero crossing rate information. Specifically, a voiced mode (stationary voiced) is determined when voiced stationarity is high in the pitch history analysis result, when voicedness is high as a result of threshold value processing of smoothed ACB gain, when energy change is less than a threshold value (for example, less than 2), and when the zero crossing rate is less than a threshold value (for example, less than 0.7), noise (noise signal) mode is determined when the zero crossing rate is greater than a threshold value (for example, 0.7 or more), and other (rising/transient) mode is determined in cases other than these.

Mode determination section 138 decides the final mode determination result according to what number lost frame in consecutively lost frames is the current frame, after carrying out mode determination. Specifically, the above mode determination result is taken as the final mode determination result up to two consecutive frames. In the third consecutive frames, when the above mode determination result is a voiced mode, this voiced mode is changed to other mode and taken as the final mode determination result. Assume that the fourth consecutive frame onwards is a noise mode. By means of this kind of final mode determination, it is possible to prevent the occurrence of a buzzer noise at the time of a burst frame loss (when three frames or more are lost consecutively), and alleviate a subjective feeling of discomfort by applying noise to the decoded signal naturally over time. What number is the lost frame in consecutively lost frames can be determined by providing a counter for the number of consecutively lost frames, that is cleared to zero when a current frame is a normal frame and increases by one at a time when this is not the case, and by referring to a value of this counter. In a case of the AMR scheme, a state machine is provided, so that the state of the state machine may be referred to.

In this way, according to this embodiment, it is possible to prevent the occurrence of the noisy perception at the time of concealment processing of voiced sections and prevent the occurrence of sound break at the time of concealment processing even in a case where gain of an immediately preceding subframe is accidentally a small value.

Further, with the above configuration, mode determination section 138 is able to carry out mode determination without carrying out pitch analysis on the decoder side, so that it is possible to reduce increase in calculation amount at the time of application to a codec that does not carry out pitch analysis at a decoder.

Moreover, with the above configuration, by changing the band of applied noise according to the number of consecutively lost frames, so that it is possible to minimize the occurrence of buzzer noise due to masking processing.

Embodiment 4

Figure 12:
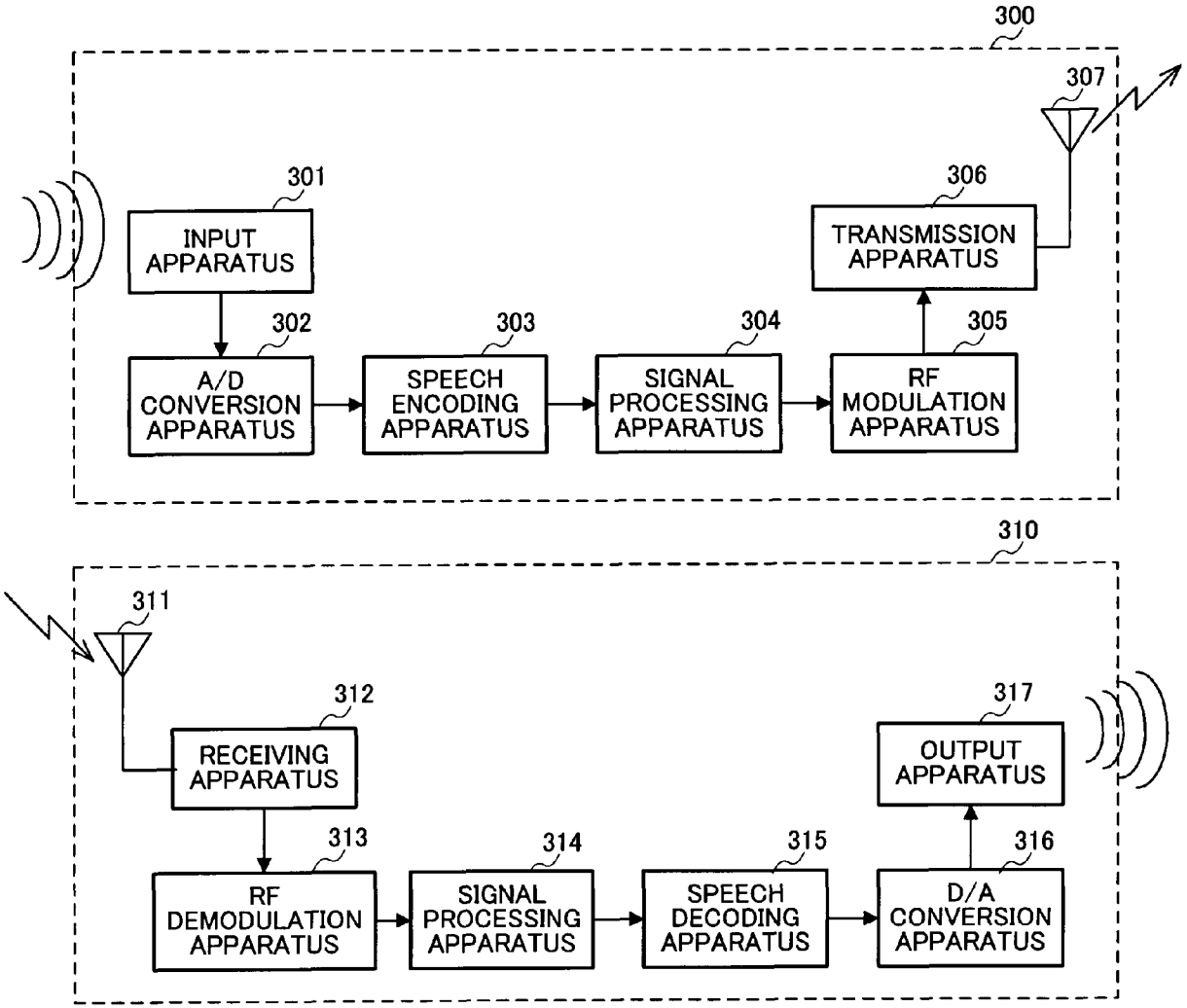
FIG. 12 is a block diagram showing a main configuration of a wireless transmission apparatus and a wireless receiving apparatus of Embodiment 4.

FIG. 12 is a block diagram showing a main configuration of wireless transmission apparatus 300 and corresponding wireless receiver apparatus 310 when a speech decoding apparatus of the present invention is applied to a wireless communication system.

Wireless transmission apparatus 300 has: input apparatus 301: A/D conversion apparatus 302: speech encoding apparatus 303: signal processing apparatus 304: RF modulation apparatus 305: transmission apparatus 306: and antenna 307:

An input terminal of A/D conversion apparatus 302 is connected to an output terminal of input apparatus 301. An input terminal of speech encoding apparatus 303 is connected to an output terminal of A/D conversion apparatus 302. An input terminal of signal processing apparatus 302 is connected to an output terminal of speech encoding apparatus 303. An input terminal of RF modulation apparatus 305 is connected to an output terminal of signal processing apparatus 304. An input terminal of transmission apparatus 306 is connected to an output terminal of RF modulation apparatus 305. Antenna 307 is connected to an output terminal of transmission apparatus 306.

Input apparatus 301 receives a speech signal, converts this signal to an analog speech signal that is an electrical signal, and supplies the converted signal to A/D converter apparatus 302. A/D converter apparatus 302 converts the analog speech signal from input apparatus 301 to a digital speech signal, and supplies this signal to speech encoding apparatus 303. Speech encoding apparatus 303 codes the digital speech signal from A/D converter apparatus 302, generates a speech encoded bit string, and provides this to signal processing apparatus 304. Signal processing apparatus 304 supplies the speech encoded bit string to RF modulation apparatus 305 after carrying out, for example, channel encoding processing, packetizing processing and transmission buffer processing on the speech encoded bit string from speech encoding apparatus 303. RF modulation apparatus 305 modulates a signal of the speech encoded bit string subjected to, for example, channel encoding processing from signal processing apparatus 304 and supplies this to transmission apparatus 306. Transmission apparatus 306 transmits the modulated speech encoded signal from RF modulation apparatus 305 as radio waves (RF signal) via antenna 307.

Wireless transmission apparatus 300 carries out processing in frame units of a number of tens of ms on the digital speech signal obtained via A/D conversion apparatus 302. When the network constituting the system is a packet network, a frame or a number of frames of encoded data is put into one packet, and this packet is transmitted to the packet network. When the network is a line switching network, packet processing and transmission buffer processing is not necessary.

Wireless receiving apparatus 310 has antenna 311; receiving apparatus 312; RF demodulation apparatus 313; signal processing apparatus 314; speech decoding apparatus 315; D/A conversion apparatus 316; and output apparatus 317. Speech decoding apparatus of this embodiment is used as speech decoding apparatus 315.

An input terminal of receiving apparatus 312 is connected to antenna 311. An input terminal of RF demodulation apparatus 313 is connected to an output terminal of receiving apparatus 312. An input terminal of signal processing apparatus 314 is connected to an output terminal of RF demodulation apparatus 313. An input terminal of speech decoding apparatus 315 is connected to an output terminal of signal processing apparatus 314. An input terminal of D/A conversion apparatus 316 is connected to an output terminal of speech decoding apparatus 315. An input terminal of output apparatus 317 is connected to an output terminal of D/A conversion apparatus 316.

Receiving apparatus 312 receives radio waves (RF signal) containing speech encoded information via antenna 311, generates a received speech encoded signal that is an analog electrical signal, and supplies this to RF decoding apparatus 313. If radio waves (RF signals) received via antenna 311 do not have signal attenuation or superimposition of noise in the transmission path, this signal is exactly the same as the radio waves (RF signal) transmitted at speech signal transmission apparatus 300. RF demodulation apparatus 313 demodulates the speech encoded signal received from receiving apparatus 312 and provides this to signal processing apparatus 314. Signal processing apparatus 314 carries out, for example, jitter absorption buffering processing, packet assembly processing, and channel decoding processing on the speech encoded signal received from RF demodulation apparatus 313, and supplies a received speech encoded bit string to speech decoding apparatus 315. Speech decoding apparatus 315 carries out decoding processing on speech encoded bit strings received from signal processing apparatus 314, generates a decoded speech signal, and supplies this to D/A conversion apparatus 316. D/A conversion apparatus 316 converts the digital decoded speech signal from speech decoding apparatus 315 to an analog decoded speech signal and supplies this to output apparatus 317. Output apparatus 317 then converts the analog decoded speech signal from D/A conversion apparatus 316 to vibrations of air and output this as a sound wave that can be heard by the human ear.

In this way, the speech decoding apparatus of this embodiment can be applied to a wireless communication system. Speech decoding apparatus of this embodiment are by no means limited to a wireless communication system, and, it goes without saying that application to, for example, a wired communication system is also possible.

This concludes the embodiments of the present invention.

The speech decoding apparatus and repaired frame generating method of the present invention is by no means limited to Embodiments 1 to 4 described above, and various modifications are possible.

Further, the speech decoding apparatus, wireless transmission apparatus, wireless receiving apparatus, and repaired frame generating method of the present invention are capable of being implemented on a communication terminal apparatus and base station terminal apparatus of a mobile communication system, and, by this means, it is possible to provide communication terminal apparatus, base station apparatus, and a mobile communication system having the same operation effects as described above.

Further, speech decoding apparatus of the present invention are also capable of being utilized in wired communication systems, and, by this means, it is also possible to provide a wired communication system having the same operation effects as described above.

Although an example has been described here where the present invention is configured with hardware, the present invention can be implemented using software. For example, it is possible to implement the same functions as a speech decoding apparatus of the present invention by describing algorithms of the repaired frame generating method of the present invention using programming language, and storing this program in memory for implementation by an information processing section.

Each function block employed in the description of each of the aforementioned embodiments may typically be implemented as an LSI constituted by an integrated circuit. These may be individual chips or partially or totally contained on a single chip.

Further, "LSI" is adopted here but this may also be referred to as "IC," "system LSI," "super LSI," or "ultra LSI" due to differing extents of integration.

Further, the method of circuit integration is not limited to LSI's, and implementation using dedicated circuitry or general-purpose processors is also possible. After LSI manufacture, utilization of an FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application in biotechnology is also possible.

This application is based on Japanese Patent Application No. 2004-212180, filed on Jul. 20, 2004, the entire content of which is expressly incorporated by reference herein.

INDUSTRIAL APPLICABILITY

The speech decoding apparatus and repaired frame generating method of the present invention is also useful in application to, for example, mobile communication systems.

The invention claimed is:

1. A speech decoding apparatus configured as a circuit comprising:

an adaptive codebook that generates an excitation signal;

an average amplitude calculator that calculates an average amplitude for one pitch period from an end of the excitation signal stored in the adaptive codebook;

a memory that holds the calculated average amplitude;

an energy change rate calculator that calculates a ratio of a first average amplitude and a second average amplitude as an energy change rate, and smoothes the energy change rate over time, the first average amplitude being calculated by the average amplitude calculator with resect to a resent calculation target period the second average amplitude being calculated by the average amplitude calculator with respect to a calculation reference period earlier than the present calculation target period, and the second average amplitude being stored in the memory;

a decider that decides to set one of the smoothed energy change rate acquired in the energy change rate calculator and an adaptive codebook gain decoded before the present calculation target period as an adaptive codebook gain for processing a generator that generates a signal for a lost frame by multiplying the excitation signal by the adaptive codebook gain for processing set by the decider with respect to the lost frame; and a noise applier that applies noise to a high-frequency band of the generated signal, wherein the noise applier determines voiced stationarity based at least on whether fluctuation of a decoding pitch period before the lost frame is large or small, and sets the high-frequency band as a frequency band to apply noise to when the voiced stationarity is determined to be low, or limits the frequency band to apply noise to, to a higher frequency part in the high-frequency band, when the voiced stationarity is determined to be high.

2. The speech encoding apparatus of claim 1, wherein the noise applier broadens the frequency band to which the noise is applied to a lower frequency band, in accordance with a consecutive number of lost frames.

3. A communication terminal apparatus comprising a speech decoding apparatus, the speech decoding apparatus being configured as a circuit comprising:

an adaptive codebook that generates an excitation signal;

an average amplitude calculator that calculates an average amplitude for one pitch period from an end of the excitation signal stored in the adaptive codebook;

a memory that holds the calculated average amplitude;

an energy change rate calculator that calculates a ratio of a first average amplitude and a second average amplitude, as an energy change rate, and smoothes the energy change rate over time, the first average amplitude being calculated by the average amplitude calculator with respect to a present calculation target period, the second average amplitude being calculated by the average amplitude calculator with respect to a calculation reference period earlier than the present calculation target period, and the second average amplitude being stored in the memory;

a decider that decides to set one of the smoothed energy change rate acquired in the energy change rate calculator and an adaptive codebook gain decoded before the present calculation target period as an adaptive codebook gain for processing;

a generator that generates a signal for a lost frame by multiplying the excitation signal by the adaptive codebook gain for processing set by the decider with respect to the lost frame; and a noise applier that applies noise to a high-frequency band of the generated signal, wherein the noise applier determines voiced stationarity based at least on whether fluctuation of a decoding pitch period before the lost frame is large or small, and sets the high-frequency band as a frequency band to apply noise to when the voiced stationarity is determined to be low, or limits the frequency band to apply noise to, to a higher frequency part in the high-frequency band, when the voiced stationarity is determined to be high.

4. A base station apparatus comprising a speech decoding apparatus, the speech decoding apparatus being configured as a circuit comprising:

an adaptive codebook that generates an excitation signal;

an average amplitude calculator that calculates an average amplitude for one pitch period from an end of the excitation signal stored in the adaptive codebook;

a memory that holds the calculated average amplitude;

an energy change rate calculator that calculates a ratio of a first average amplitude and a second average amplitude, as an energy change rate, and smoothes the energy change rate over time, the first average amplitude being calculated by the average amplitude calculator with respect to a present calculation target period, the second average amplitude being calculated by the average amplitude calculator with respect to a calculation reference period earlier than the present calculation target period, and the second average amplitude being stored in the memory;

a decider that decides to set one of the smoothed energy change rate acquired in the energy change rate calculator and an adaptive codebook gain decoded before the present calculation target period as an adaptive codebook gain for processing;

a generator that generates a signal for a lost frame by multiplying the excitation signal by the adaptive codebook gain for processing set by the decider with respect to the lost frame; and a noise applier that applies noise to a high-frequency band of the generated signal, wherein the noise applier determines voiced stationarity based at least on whether fluctuation of a decoding pitch period before the lost frame is large or small, and sets the high-frequency band as a frequency band to apply noise to when the voiced stationarity is determined to be low, or limits the frequency band to apply noise to, to a higher frequency part in the high-frequency band, when the voiced stationarity is determined to be high.

5. A speech decoding method comprising:

an average amplitude calculating step of calculating an average amplitude for one pitch period from an end of an excitation signal stored in an adaptive codebook;

a holding step of holding the calculated average amplitude;

an energy change rate calculating step of calculating a ratio of a first average amplitude and a second average amplitude, as an energy change rate, and smoothing the energy change rate over time, the first average amplitude being calculated in the average amplitude calculating step with respect to a present calculation target period, the second average amplitude being calculated in the average amplitude calculating step with respect to a calculation reference period earlier than the present calculation target period and held;

a deciding step of deciding to set one of the smoothed energy change rate acquired in the energy change rate calculating step and an adaptive codebook gain decoded before the present calculation target period, as an adaptive codebook gain for processing a generating step of generating a signal for a lost frame by multiplying the excitation signal by the adaptive codebook gain for processing determined in the deciding step with respect to the lost frame; and a noise applying step of applying noise to a high-frequency band of the generated signal, wherein, in the noise applying step, voiced stationarity is determined based at least on whether fluctuation of a decoding pitch period before the lost frame is large or small, and the high-frequency band is set as a frequency band to apply noise to when the voiced stationarity is determined to be low, or the frequency band to apply noise to is limited to a higher frequency part in the high-frequency band, when the voiced stationarity is determined to be high.

* * * * *